US010584449B2

(12) United States Patent
Jennings

(10) Patent No.: US 10,584,449 B2
(45) Date of Patent: Mar. 10, 2020

(54) START ASSIST FOR A VIBRATORY SYSTEM OF A COMPACTOR

(71) Applicant: Caterpillar Paving Products Inc., Brooklyn Park, MN (US)

(72) Inventor: Todd M. Jennings, Ramsey, MN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/026,324

(22) Filed: Jul. 3, 2018

(65) Prior Publication Data

US 2020/0011016 A1 Jan. 9, 2020

(51) Int. Cl.

| | |
|---|---|
| ***E01C 19/28*** | (2006.01) |
| ***B06B 1/16*** | (2006.01) |
| ***F15B 1/027*** | (2006.01) |
| ***E02D 3/046*** | (2006.01) |

(52) U.S. Cl.

CPC ..... *E01C 19/286* (2013.01); *B06B 1/162* (2013.01); *E02D 3/046* (2013.01); *F15B 1/027* (2013.01)

(58) Field of Classification Search

CPC ..... E01C 19/286; E02D 3/046; B06B 1/162; F15B 1/027

USPC ..... 404/113, 117, 118; 60/596

See application file for complete search history.

(56) References Cited

U.S. PATENT DOCUMENTS

| | | | | |
|---|---|---|---|---|
| 8,585,317 | B1 | 11/2013 | Sina | |
| 8,708,599 | B2 | 4/2014 | Steffen | |
| 9,782,800 | B2 | 10/2017 | Renz et al. | |
| 10,167,835 | B2 * | 1/2019 | Dolger | F02N 7/00 |
| 10,288,094 | B2 * | 5/2019 | Spielvogel | F04B 49/22 |
| 2010/0236232 | A1 * | 9/2010 | Boehm | E02F 9/123 60/413 |
| 2015/0204355 | A1 * | 7/2015 | Krittian | B60K 6/12 60/596 |
| 2016/0319496 | A1 * | 11/2016 | Wiktor | E01C 19/286 |

FOREIGN PATENT DOCUMENTS

| | | |
|---|---|---|
| CN | 204080597 | 1/2015 |
| CN | 204239353 | 4/2015 |
| CN | 104329299 | 11/2016 |
| EP | 3034700 | 5/2017 |
| WO | 2013/054262 | 4/2013 |

* cited by examiner

*Primary Examiner* — Raymond W Addie

(74) *Attorney, Agent, or Firm* — Harrity & Harrity LLP

(57) ABSTRACT

A hydraulic system may selectively operate in a charging mode or a driving mode, and may include a charging component, an accumulator, an input pump/motor, and an output motor. The charging component may charge an accumulator during operation in the charging mode. The accumulator may store pressure medium during operation in the charging mode, and may supply stored pressure medium to the input pump/motor during operation in the driving mode. The input pump/motor may supply pressure medium to at least the accumulator during operation in the charging mode, and may supply pressure medium to the output motor during at least operation in the driving mode. The output motor may provide output torque based on pressure medium supplied by the input pump/motor.

20 Claims, 11 Drawing Sheets

START ASSIST FOR A VIBRATORY SYSTEM OF A COMPACTOR

TECHNICAL FIELD

The present disclosure relates generally to a vibratory system in a compactor and, more particularly, to a start assist for a vibratory system of a compactor.

BACKGROUND

A compactor (sometimes referred to as a vibrating roller) is, in general, a machine used to compact a material (e.g., soil, a base layer, an anti-frost layer, asphalt, and/or the like) over which the compactor moves. A compactor can include a vibratory system that causes a vibration component of the compactor to vibrate as the compactor moves over the material, thereby improving compaction of the material (e.g., as compared compaction without vibration). For example, the vibratory system may include an output motor (e.g., a hydraulic motor) that is connected, via an output shaft, to an unbalance vibrator arranged in a drum of the compactor. Here, the output motor provides output torque to the output shaft. The output torque causes the unbalance vibrator to rotate, which, due to the unbalanced nature of the unbalance vibrator, causes the drum to vibrate. Generally, the output motor is driven by an input pump (e.g., a hydraulic pump) that is connected, via an input shaft, to an engine of the compactor (e.g., an internal combustion engine), that provides input torque to the input pump. The compactor also typically includes a (separate) propulsion system, including a propulsion motor, associated with moving the compactor over the material.

In operation, the vibratory system and the propulsion system can be started at the same time (e.g., such that the drum begins vibrating when the compactor begins moving), which requires a comparatively high amount of engine power requirement. However, once the vibratory system is started, the vibratory system requires comparatively less engine power in order to maintain a given vibratory speed. As such, the amount of engine power required after startup of the vibratory system is comparatively lower than the amount of engine power required at startup. Nonetheless, the compactor engine must be designed to provide the amount of engine power required when the vibratory system and the propulsion system are started at the same time.

One attempt to providing startup assistance to a vibratory system, in order to reduce required engine power, is disclosed in U.S. Pat. No. 9,782,800 that issued to Robert Bosch GmbH on Oct. 10, 2017, ("the '800 patent"). In particular, the '800 patent discloses an energy recovery possibility for a vibrating roller by means of a vibratory drive. The basic idea disclosed in the '800 patent is to use a vibratory drive of a vibrating roller for energy recovery, where the vibrating roller comprises an unbalance vibrator that is inserted in a rotatable fashion in a drum that is driven by a propulsion motor. In the '800 patent, the unbalance vibrator is mechanically coupled to a hydraulic motor (via an output shaft), and the hydraulic motor is supplied with a pressure medium by a hydraulic pump. According to the '800 patent, the vibratory drive includes a high-pressure accumulator that serves to accommodate pressure medium delivered by the hydraulic motor in an "overrun mode" (i.e., when a torque is applied from the output shaft to the hydraulic motor in a coasting mode of the unbalance vibrator). In other words, the '800 patent discloses the vibratory drive as a drive which is relevant for the recovery of energy.

According to the '800 patent, in one embodiment, the hydraulic pump and the hydraulic motor are arranged in a closed circuit in which, in the overrun mode, a downstream connection of the hydraulic motor can be fluidically connected to the high-pressure accumulator, and in an acceleration mode (starting up of the unbalance vibrator) an upstream connection of the hydraulic motor can be fluidically connected to the high pressure accumulator. As an alternative embodiment, the '800 patent describes that the hydraulic pump and the hydraulic motor are arranged in an open circuit in which the downstream connection of the hydraulic motor can be fluidically connected to a tank or to the high-pressure accumulator.

While the vibratory drive of the '800 patent may provide some plausible solutions for energy recovery using a vibratory drive, the vibratory drive of the '800 patent has numerous shortcomings. For example, the vibratory drive of the '800 patent discloses vibratory drives that add power (from the high-pressure accumulator) at the hydraulic motor. In operation, such a configuration requires tight coordination between the hydraulic pump and the hydraulic motor of the vibratory drive, which can result in complex switching scenarios, timing issues, and/or the like. Furthermore, the vibratory drive disclosed in the '800 patent provides a high-pressure accumulator that accommodates pressure medium only in the overrun mode, but not during other times of operation, such as during "normal" operation of the vibrating roller.

The vibratory system of the present disclosure solves one or more of the problems set forth above and/or other problems in the art.

SUMMARY

In one aspect, the present disclosure is related to a compactor including a vibratory system to selectively operate in a charging mode or a driving mode, the vibratory system comprising: a charging component to charge an accumulator during operation of the vibratory system in the charging mode; the accumulator to store pressure medium during operation of the vibratory system in the charging mode, and supply stored pressure medium to an input pump/motor during operation in the driving mode; the input pump/motor to supply pressure medium to at least the accumulator during operation of the vibratory system in the charging mode, and supply pressure medium to an output motor during at least operation of the vibratory system in the driving mode; and the output motor to provide, to a vibration component of the vibratory system, output torque based on pressure medium supplied by the input pump/motor.

In another aspect, the present disclosure is related to a hydraulic system to selectively operate in a charging mode or a driving mode, the hydraulic system comprising: a charging component to charge an accumulator during operation in the charging mode; the accumulator to store pressure medium during operation in the charging mode, and supply stored pressure medium to an input pump/motor during operation in the driving mode; the input pump/motor to supply pressure medium to at least the accumulator during operation in the charging mode, and supply pressure medium to an output motor during at least operation in the driving mode; and the output motor to provide output torque based on pressure medium supplied by the input pump/motor.

In yet another aspect, the present disclosure is related to a method, comprising: charging, by a charging component of a hydraulic system, an accumulator of the hydraulic system, wherein the charging component charges the accumulator during operation of the hydraulic system in a charging mode; supplying, by the accumulator, stored pressure medium to an input pump/motor of the hydraulic system, wherein the accumulator supplies the stored pressure medium during operation of the hydraulic system in a driving mode; supplying, by the input pump/motor, pressure medium to an output motor of the hydraulic system; and providing, by the output motor, output torque based on the pressure medium supplied by the input pump/motor.

DETAILED DESCRIPTION

Figure 1:
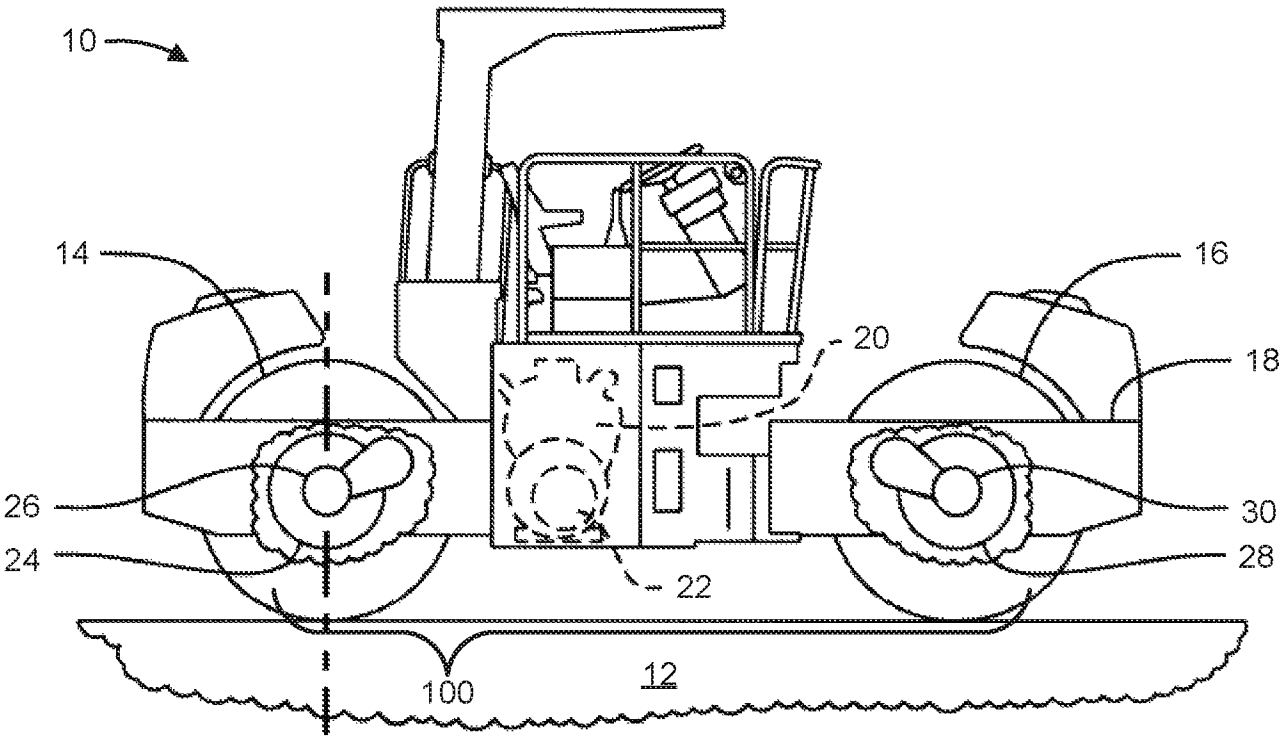
FIG. 1 is a diagram of an example compactor including a vibratory system with startup assistance, as described herein.

FIG. 1 is a diagram of an example compactor 10 including a vibratory system with startup assistance.

A compactor 10 may include a machine for increasing density of (i.e., compacting) a compactable material 12, such as soil, gravel, a bituminous mixture, a base layer, an anti-frost layer, asphalt, and/or the like. The compactor 10, for example, can be a double drum vibratory compactor, having a first drum 14 and a second drum 16 rotatably mounted on a main frame 18. The main frame 18 may also support an engine 20 that has an input pump/motor 22 (e.g., a hydraulic pump/motor) connected thereto.

As shown in FIG. 1, first drum 14 may include a first vibration component 24 (e.g., one or more unbalance vibrators) that is operatively connected to a first output motor 26 (e.g., a hydraulic motor), while second drum 16 may include a second vibration component 28 (e.g., one or more unbalance vibrators) that is operatively connected to a second output motor 30. It should be understood that first drum 14 and second drum 16 may have more than one vibration component per drum, in some implementations. Further, it should be understood that, while compactor 10 is illustrated as a double drum compactor, compactor 10 may be a single drum compactor, in some implementations.

In some implementations, input pump/motor 22 may be included in a vibratory system 100 associated with providing output torque to vibration component 26 and/or vibration component 30, as described below.

As indicated above, FIG. 1 is provided as an example. Other examples are possible and may differ from what was described in connection with FIG. 1.

Figure 2:
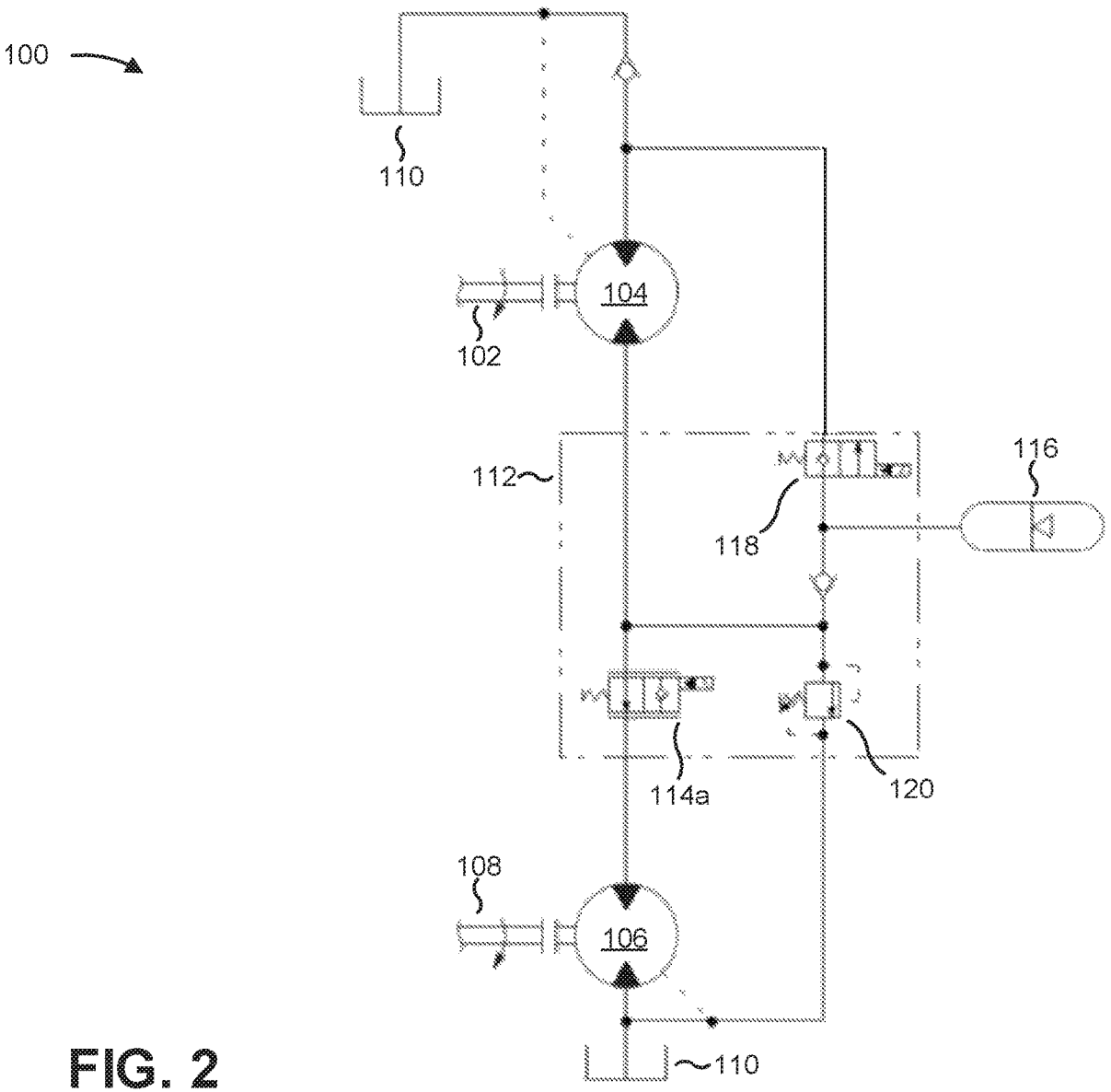
FIGS. 2-10 are diagrams of various implementations of a vibratory system with startup assistance, as described herein.

FIG. 2 is a diagram of vibratory system 100 in which startup assistance is provided based on inducing an artificially elevated load on input pump/motor 22 in order to charge an accumulator.

As shown in FIG. 2, vibratory system 100 may include an input shaft 102, an input pump/motor 104 (corresponding to input pump/motor 22), an output motor 106 (corresponding to first output motor 26 or second output motor 28), an output shaft 108, a pressure medium tank 110 (herein referred to as tank 110), a charging component 112, and an accumulator 116. As shown, in vibratory system 100, charging component 112 includes a proportional switching valve 114*a*, a switching valve 118, and a safety valve 120.

Input shaft 102 is a rotatable shaft configured to provide input torque to input pump/motor 104. In some implementations, input shaft 102 is mechanically coupled to engine 20 (e.g., an internal combustion engine of compactor 10), and provides the input torque to input pump/motor 104 based on this mechanical coupling (i.e., based on input shaft 102 being rotated by engine 20).

Input pump/motor 104 is a component capable of supplying pressure medium to output motor 106 and/or accumulator 116. For example, input pump/motor 104 may, via an outlet of input pump/motor 104, supply pressure medium to accumulator 116 (and optionally output motor 106) during operation of vibratory system 100 in a charging mode, and may supply pressure medium to output motor 106 during operation of vibratory system 100 in a driving mode (and optionally during operation in the charging mode), as described below.

In some implementations, input pump/motor 104 can operate as a pump. For example, when input pump/motor 104 supplies pressure medium based on input torque provided by input shaft 102, input pump/motor 104 operates as a pump. Additionally, or alternatively, input pump/motor 104 can operate as a motor. For example, when input pump/motor 104 supplies pressure medium based on being driven by accumulator 116 (e.g., based on pressure medium supplied by accumulator 116), input pump/motor 104 operates as a motor. In some implementations, input pump/motor 104 can operate as a combined pump/motor (e.g., when input pump/motor 104 supplies pressure medium based on both input torque provided by input shaft 102 and based on being driven by accumulator 116).

Output motor 106 is a motor capable of providing output torque to output shaft 108. In some implementations, output motor 106 is driven by input pump/motor 104 (e.g., based on supplied pressure medium by input pump/motor 104) during operation of vibratory system 100 in the charging mode or operation in the driving mode, as described below.

Output shaft 108 is a rotatable shaft that receives output torque, provided by output motor 106, and rotates a vibration component to which output shaft 108 is mechanically coupled. For example, output shaft 108 may be mechanically coupled to an unbalance vibrator (e.g., first vibration component 24 or second vibration component 28) that, upon rotation, causes a drum (e.g., first drum 14 or second drum 16) of compactor 10 to vibrate.

Tank 110 includes a vessel for storing and providing pressure medium in vibratory system 100. For example, tank 110 may store pressure medium supplied by output motor 106, and may supply pressure to input pump/motor 104 (e.g., based on input pump/motor 104 being driven by input shaft 102).

Charging component 112 includes a component capable of charging accumulator 116. In some implementations, charging component 112 may be configured to charge accumulator 116 when vibratory system 100 operates in a charging mode, as described below. As shown in FIG. 2, in vibratory system 100, charging component 112 includes proportional switching valve 114*a*, switching valve 118, and safety valve 120.

Proportional switching valve 114*a* includes a valve associated with inducing an artificially elevated load on input pump/motor 104 (e.g., upstream of proportional switching valve 114*a*). For example, proportional switching valve 114*a* can be at least partially closed in order to induce an elevated load on input pump/motor 104 when vibratory system 100 operates in the charging mode, as described below.

Switching valve 118 includes a valve that selectively permits accumulator 116 to supply pressure medium to input pump/motor 104. For example, switching valve 118 may prevent accumulator 116 from supplying pressure medium to input pump/motor 104 when vibratory system 100 operates in the charging mode, and may permit accumulator 116 to supply pressure medium to input pump/motor 104 when vibratory system 100 operates in the driving mode, as described below.

Safety valve 120 includes a pressure-limiting valve that serves as a safety valve for vibratory system 100. In some implementations, safety valve 120 may be set to a higher-than-expected pressure (e.g., 250 kilopascals (bar)) in order to provide safety valve functionality. Notably, while safety valve 120 is illustrated as being included in charging component 112, in some implementations, safety valve 120 may be arranged at another position in vibratory system 100 (e.g., safety valve 120 may be external to charging component 112).

Accumulator 116 includes an accumulator capable of storing pressure medium and supplying stored pressure medium in order to drive input pump/motor 104. For example, accumulator 116 may store pressure medium when vibratory system 100 operates in a charging mode, and may supply stored pressure medium to input pump/motor 104 when vibratory system 100 operates in the driving mode, as described below.

In some implementations, vibratory system 100 may include one or more other components. For example, while not shown, vibratory system 100 may include or be connect to a controller (e.g., an electronic controller) that is configured to monitor conditions (e.g., states of switching valves, pressure, vibratory speed, and/or the like) within vibratory system 100 and open and closing switching valves of vibratory system 100 (e.g., in association with operating in the charging mode or the driving mode), as needed.

The charging mode, as described herein, is a mode of operation of vibratory system 100 during which charging component 112 operates to charge accumulator 116 (e.g., such that accumulator 116 stores pressure medium). Conversely, the driving mode, as described herein, is a mode of operation of vibratory system 100 during which accumulator 116 operates to supply stored pressure medium to input pump/motor 104 (e.g., such that output motor 106 can be driven by input pump/motor 104 at least partially based on stored pressure medium supplied by accumulator 116).

In vibratory system 100, startup assistance can be provided during operation in the driving mode based inducing an artificially elevated load induced on input pump/motor 104 during operation of vibratory system 100 in the charging mode.

For example, as described above, after initial startup of input pump/motor 104 (e.g., after vibratory system 100 reaches a steady state such that vibration is occurring at a desired vibratory speed), an amount of power needed from engine 20 is reduced. In other words, in this steady state condition, engine 20 is capable of producing power above an amount required to maintain the desired vibratory speed.

From this steady state, vibratory system 100 can operate in the charging mode. In the charging mode of operation, proportional switching valve 114*a* can be at least partially closed (e.g., proportionally closed), an effect of which is to induce an elevated load on input pump/motor 104. In other words, a load on input pump/motor 104 is increased (e.g., by an amount proportional to a degree to which proportional switching valve 114*a* is closed) to an amount that is higher than needed in order to maintain the desired vibratory speed. In this example, engine 20 provides additional power based on the artificially elevated load, and switching valve 118 is in a closed position in order to cause charge accumulator 116 to be charged (e.g., in order to cause accumulator 116 to store pressure medium).

As a particular example, assume that 200 bar of pressure is needed to start vibratory system 100, and that 100 bar of pressure is needed to maintain a desired vibratory speed. Here, if proportional switching valve 114*a* was not present, only 100 bar of pressure could be charged into accumulator 116. However, by including proportional switching valve 114*a* and proportionally closing proportional switching valve 114*a*, an artificially elevated load can be induced on input pump/motor 104. For example, proportional switching valve 114*a* can be at least partially closed in order to induce input pump/motor 104 to provide 200 bar of pressure upstream of proportional switching valve 114*a*, causing 200 bar of pressure to be charged into accumulator 116, while maintaining 100 bar of pressure at output motor 106.

Notably, during operation of vibratory system 100 in the charging mode, input pump/motor 104 supplies pressure medium to both accumulator 116 and output motor 106. In other words, during operation in the charging mode, vibratory system 100 causes output motor 106 to turn (e.g., such that output torque is provided to output shaft 108), while also charging accumulator 116. Put another way, vibratory system 100 is on during operation in the charging mode.

In some implementations, vibratory system 100 may operate in the driving mode after vibratory system 100 operates in the charging mode. For example, assume that vibratory system 100 ceases causing output motor 106 to turn (e.g., such that output torque is not being provided to output shaft 108), and that accumulator 116 has been charged during operation in the charging mode, as described above. In other words, assume that vibratory system 100 is off and that accumulator 116 has been charged.

In this example, vibratory system 100 may operate in the driving mode in order to provide startup assistance to vibratory system 100. During operation in the driving mode, switching valve 118 is opened, which permits accumulator 116 to supply stored pressure medium to an inlet of input pump/motor 104. Here, proportional switching valve 114*a* is also opened (e.g., such that no artificially elevated load is induced on input pump/motor 104), and input pump/motor 104 supplies pressure medium to output motor 106 based at least in part on pressure medium supplied by accumulator 116. In this case, input pump/motor 104 acts as a motor driven by accumulator 116, and an amount of power needed from engine 20 is reduced (e.g., as compared to starting vibratory system 100 without pressure medium supplied by accumulator 116) since input pump/motor 104 is at least partially driven by accumulator 116.

In some implementations, vibratory system 100 can be started by accumulator 116 without requiring power from engine 20 (e.g., without input torque being provided by engine 20). Additionally, or alternatively, when accumulator 116 supplies more power than needed, input pump/motor 104 can operate to turn input shaft 102 such that power is provided back to engine 20 by vibratory system 100. In this way, vibratory system 100 can provide startup assistance based on inducing an artificially elevated load on input pump/motor 104.

In some implementations, in addition to charging accumulator 116 based on inducing an artificially elevated load on input pump/motor 104 while a vibratory system is on, vibratory system 100 can be configured to charge accumulator 116 while vibratory system 100 is off (e.g., while output motor 106 is not caused to turn).

Figure 3:
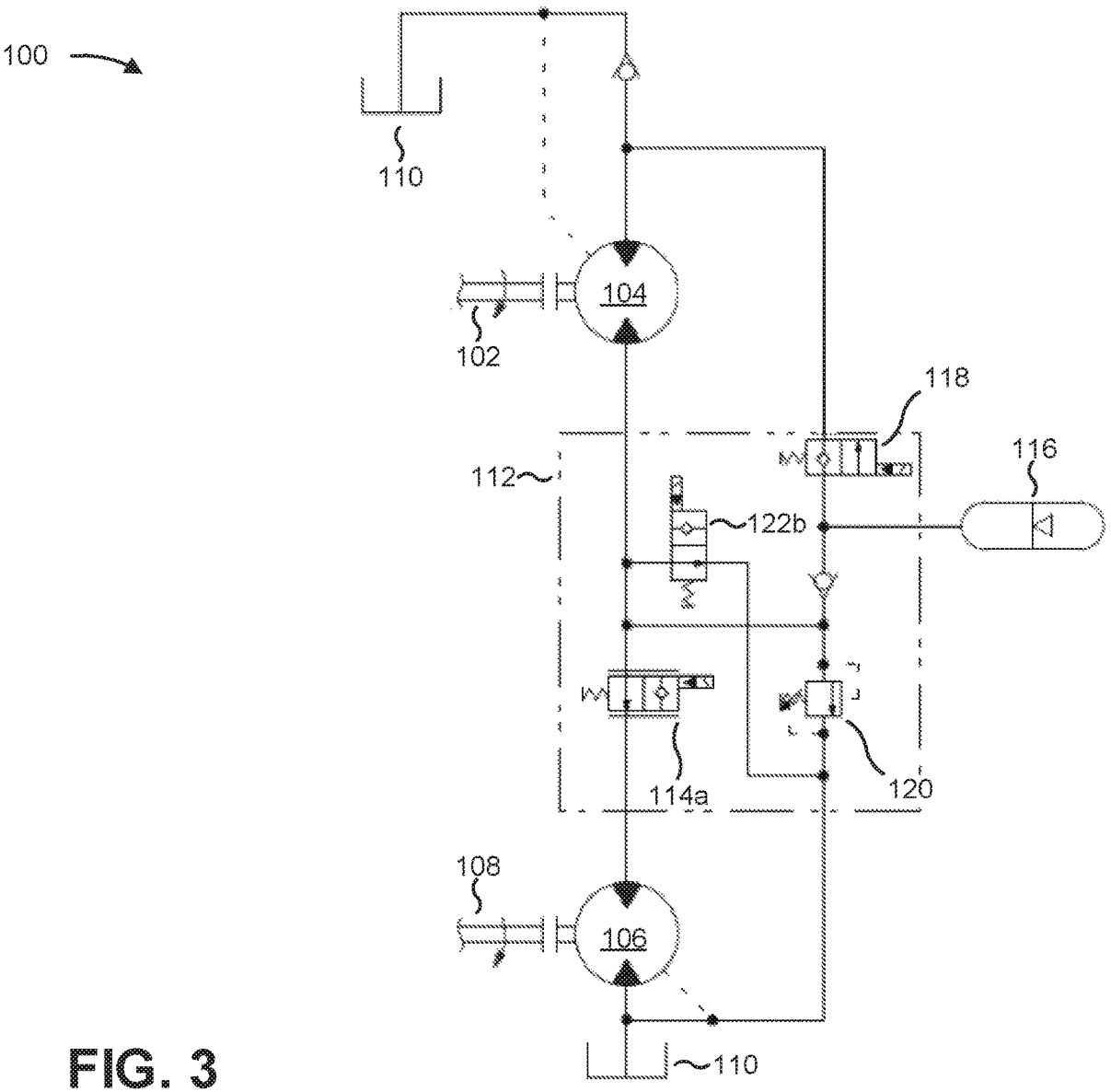

FIG. 3 is a diagram of vibratory system 100 in which startup assistance is provided based on inducing an artificially elevated load on input pump/motor 104 in order to charge accumulator 116, or based on charging accumulator 116 while vibratory system 100 is off.

As shown in FIG. 3, in some implementations, charging component 112 may include a switching valve 122*b* (e.g., in addition to proportional switching valve 114*a*, switching valve 118, and safety valve 120).

Switching valve 122*b* includes a valve that integrates on/off functionality into vibratory system 100. For example, when switching valve 122*b* is in an open position and proportional switching valve 114*a* is in a closed position, switching valve 122*b* causes any pressure medium supplied by input pump/motor 104 to bypass output motor 106 and be directed to tank 110. In such a case, vibratory system 100 is off (e.g., since output motor 106 is not being supplied pressure medium such that output motor 106 is not causing output shaft 108 to turn).

In some implementations, when operating in the charging mode, vibratory system 100 can charge accumulator 116 while vibratory system 100 is off. For example, in the charging mode of operation, switching valve 122*b*, proportional switching valve 114*a*, and switching valve 118 can be in a closed position, an effect of which is to cause input pump/motor 104 to supply pressure medium only to accumulator 116. When vibratory system 100 is operating in this manner, power provided by engine 20, via input torque to input pump/motor 104, is used only to charge accumulator 116, while output motor 106 is not caused to turn.

In some implementations, when operating in the charging mode, vibratory system 100 can charge accumulator 116 based on an artificially elevated load induced on input pump/motor 104 by proportional switching valve 114*a* (e.g., while vibratory system 100 is on), in a manner similar to that described above with regard to FIG. 2. In such a case, switching valve 122*b* is in a closed position in order to prevent pressure medium from bypassing output motor 106.

In the driving mode of operation, vibratory system 100 may operate such that input pump/motor 104 supplies pressure medium to output motor 106, as described above with regard to FIG. 2. In the driving mode of operation, switching valve 122*b* is in a closed position in order to prevent pressure medium from bypassing output motor 106. In this way, vibratory system 100 can provide startup assistance based on inducing an artificially elevated load on input pump/motor 104 or based on charging accumulator 116 while vibratory system 100 is off.

In some implementations, vibratory system 100 can be configured to proportionally charge accumulator 116 while vibratory system 100 is off. In some implementations, this can be achieved when charging component 112 includes a proportional switching valve (e.g., rather than switching valve 122*b*).

Figure 4:
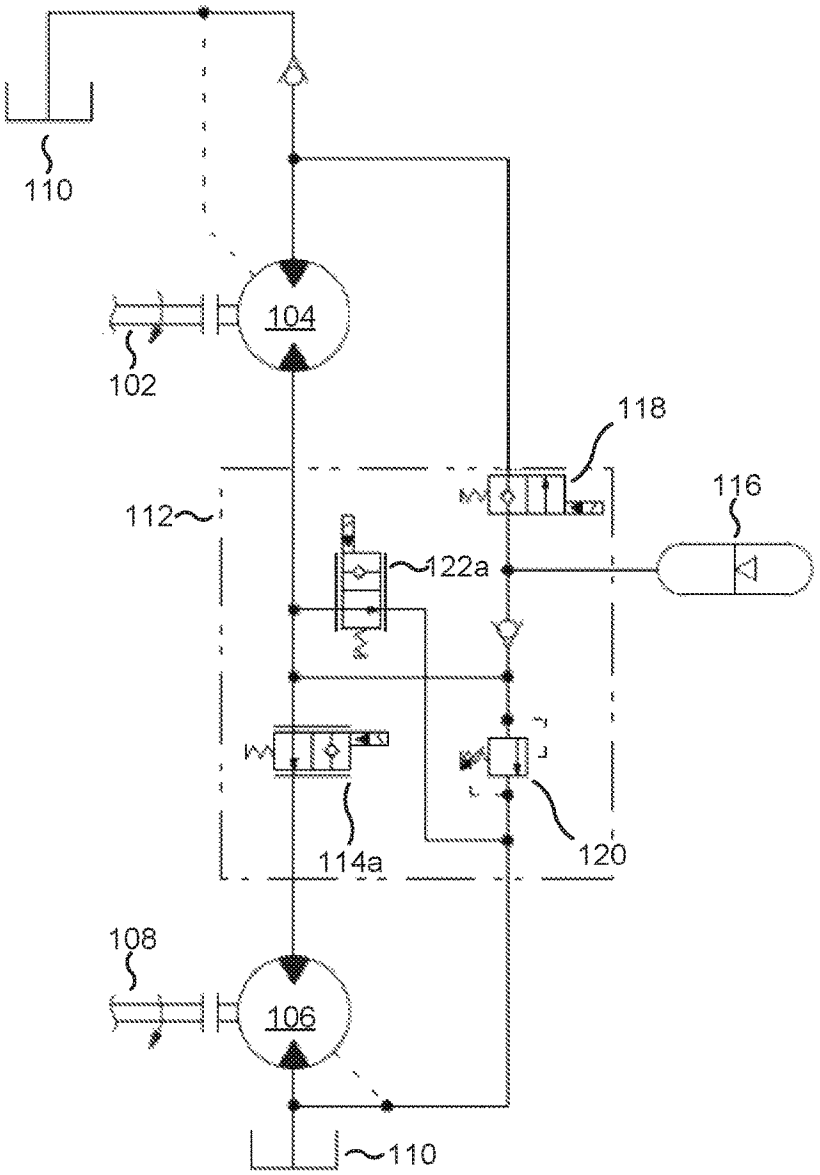

FIG. 4 is a diagram of vibratory system 100 in which startup assistance is provided based on inducing an artificially elevated load on input pump/motor 104 in order to charge accumulator 116 or based on proportionally charging accumulator 116 while vibratory system 100 is off.

As shown in FIG. 4, in some implementations, charging component 112 may include a proportional switching valve 122*a* (e.g., rather than switching valve 122*b*, as in vibratory system 100).

Proportional switching valve 122*a* is similar to switching valve 122*b*, except that proportional switching valve 122*a* can be partially closed to varying degrees (e.g., rather than being in an open position or a closed position, as with switching valve 122*b*). As such, proportional switching valve 122*a* integrates on/off functionality into vibratory system 100.

In some implementations, when operating in the charging mode, vibratory system 100 can proportionally charge accumulator 116 while vibratory system 100 is off. For example, in the charging mode of operation, proportional switching valve 122*a* can be in a partially closed position, while proportional switching valve 114*a* and switching valve 118 can be in a closed position. An effect of this configuration is to cause some pressure medium, supplied by input pump/motor 104, to bypass output motor 106, while allowing other pressure medium to charge accumulator 116. Here, a degree to which accumulator 116 is charged is proportional to a degree to which proportional switching valve 122*a* is closed. When vibratory system 100 is operating in this manner, a portion of the power provided by engine 20 is used to charge accumulator 116, while output motor 106 is not caused to turn.

In some implementations, proportional charging of accumulator 116 allows charging of accumulator 116 to be controlled and/or gradually increased, as desired (e.g., charging of accumulator 116 can be gradually ramped up based on gradually closing proportional switching valve 122*a*).

In some implementations, vibratory system 100 of FIG. 4 may operate in the charging mode such that accumulator 116 is charged based on an artificially elevated load induced on input pump/motor 104 by proportional switching valve 114*a* (e.g., while vibratory system is on). Such operation can be achieved in a manner similar to the described above with regard to FIG. 2. In such a case, proportional switching valve 122*a* is in a closed position in order to prevent pressure medium from bypassing output motor 106.

In the driving mode of operation, vibratory system 100 may operate such that input pump/motor 104 supplies pressure medium to output motor 106, as described above with regard to FIG. 2. In such a case, proportional switching valve 122*a* is in a closed position in order to prevent pressure medium from bypassing output motor 106. In this way, vibratory system 100 can provide startup assistance based on inducing an artificially elevated load on input pump/motor 104 or based on proportionally charging accumulator 116 while vibratory system 100 is off.

In some implementations, vibratory system 100 can be configured to charge accumulator 116 while vibratory system 100 is off, without being capable of charging accumulator 116 based on inducing an artificially elevated load on input pump/motor 104 while vibratory system 100 is on.

Figure 5:
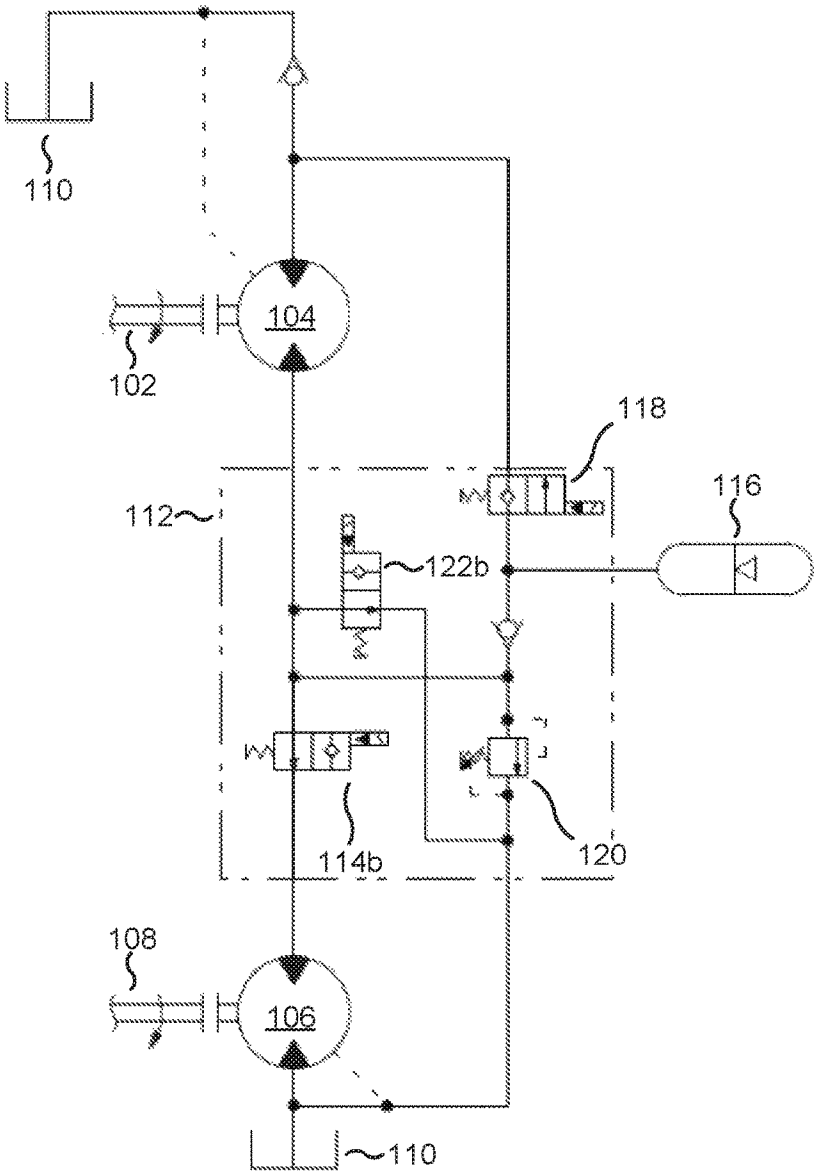

FIG. 5 is a diagram of vibratory system 100 in which startup assistance is provided based on charging accumulator 116 while vibratory system 100 is off.

As shown in FIG. 5, in some implementations, charging component 112 includes a switching valve 114*b* (e.g., rather than a proportional switching valve 114*a*).

Switching valve 114*b* is similar to proportional switching valve 114*a*, except that switching valve 114*b* can be in an open position or a closed position (e.g., rather than being capable of being partially closed to varying degrees).

In some implementations, when operating in the charging mode, vibratory system 100 can charge accumulator 116 while vibratory system 100 is off, as described above with regard to FIG. 3.

In some implementations, when operating in the driving mode, vibratory system 100 may operate such that input pump/motor 104 supplies pressure medium to output motor 106, in a manner similar to that described above with regard to FIG. 2. As such, vibratory system 100 can provide startup assistance based on charging accumulator 116 while vibratory system 100 is off.

In some implementations, vibratory system 100 can be configured to proportionally charge accumulator 116 while vibratory system 100 is off, without being capable of charging accumulator 116 based on inducing an artificially elevated load on input pump/motor 104 while vibratory system 100 is on.

Figure 6:
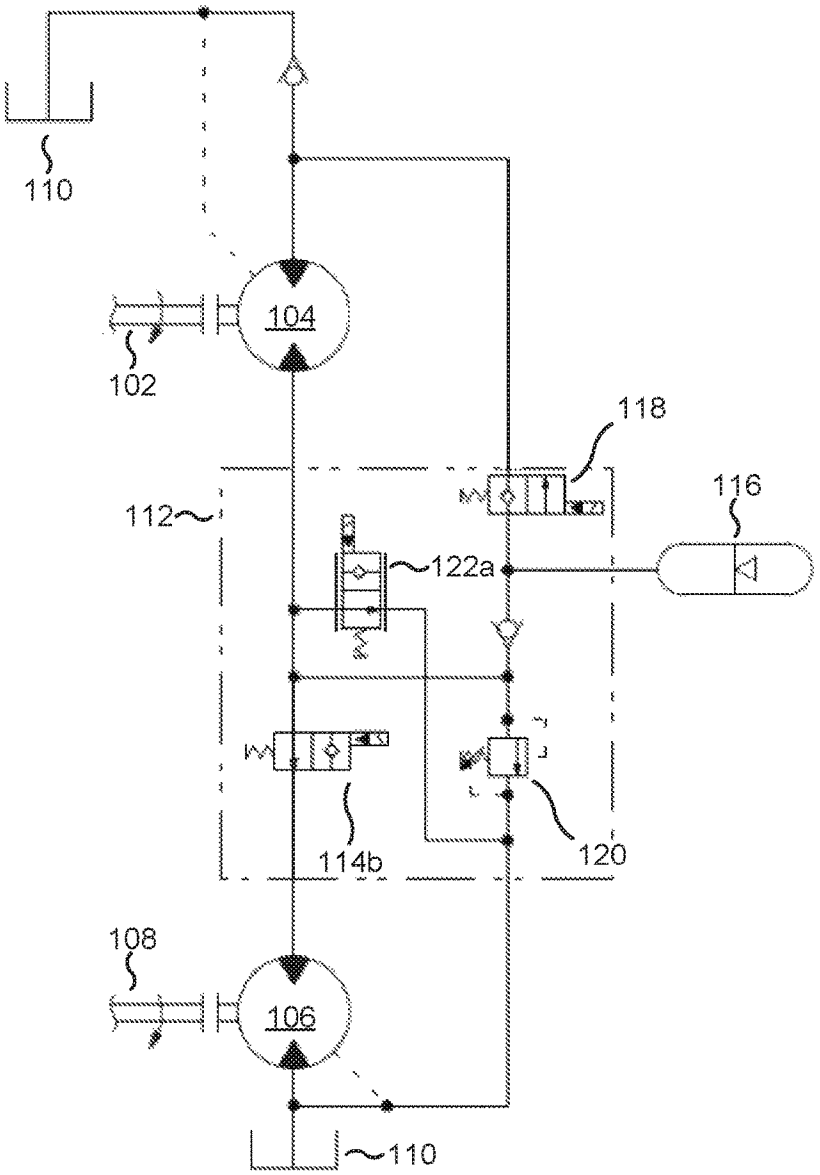

FIG. 6 is a diagram of vibratory system 100 in which startup assistance is provided based on proportionally charging accumulator 116 while vibratory system 100 is off.

As shown in FIG. 6, in some implementations, charging component 112 may include a switching valve 114*b* (e.g., rather than a proportional switching valve 114*a*).

In some implementations, when operating in the charging mode, vibratory system 100 can proportionally charge accumulator 116 while vibratory system 100 is off, as described above with regard to FIG. 4.

In some implementations, when operating in the driving mode, vibratory system 100 may operate such that input pump/motor 104 supplies pressure medium to output motor 106, in a manner similar to that described above with regard to FIG. 2. As such, vibratory system 100 can provide startup assistance based on proportionally charging accumulator 116 while vibratory system 100 is off.

Figure 7:
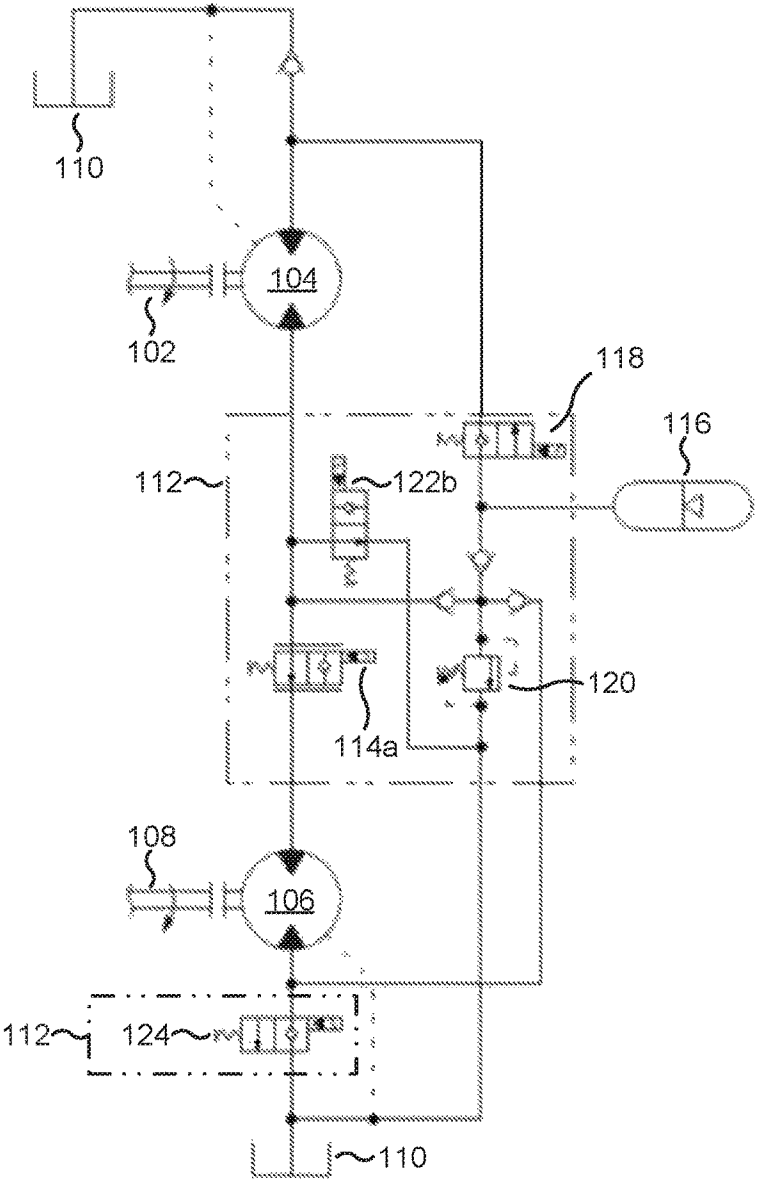

FIG. 7 is a diagram of vibratory system 100 in which startup assistance is provided based on inducing an artificially elevated load on input pump/motor 104 in order to charge accumulator 116, based on charging accumulator 116 while vibratory system 100 is off, or based on charging accumulator 116 during deceleration of vibratory system 100.

As shown in FIG. 7, in some implementations, charging component 112 may include a switching valve 124 (e.g., in addition to proportional switching valve 114*a*, switching valve 122*b*, switching valve 118, and safety valve 120).

Switching valve 124 includes a valve that permits vibratory system 100 to charge accumulator 116 based on pressure medium supplied by output motor 106 (e.g., during deceleration of vibratory system 100). For example, assume that vibratory system 100 is in an off state (e.g., such that output motor 106 is not caused to turn by pressure medium supplied by input pump/motor 104). In such a case, output shaft 108 may continue to rotate (e.g., based on energy provided via rotation of an unbalance vibrator affixed to output shaft 108). Here, when operating in the charging mode, vibratory system 100 can charge accumulator 116 based on the pressure medium supplied by output motor 106. For example, switching valve 124 and switching valve 118 can be in a closed position, which causes pressure medium, supplied by output motor 106, to charge accumulator 116. Thus, accumulator 116 can be charged during deceleration of vibratory system 100 (e.g., while a rotational speed of output shaft 108 decelerates).

In some implementations, vibratory system 100 may operate in the charging mode such that accumulator 116 is charged based on an artificially elevated load induced on input pump/motor 104 by proportional switching valve 114*a* (e.g., while vibratory system is on), as described above with regard to FIG. 2. Additionally, or alternatively, vibratory system 100 may operate in the charging mode such that accumulator 116 is charged while vibratory system 100 is off, as described above with regard to FIG. 3.

In the driving mode of operation, vibratory system 100 may operate such that input pump/motor 104 supplies pressure medium to output motor 106, as described above with regard to FIG. 2. In such a case, switching valve 124 is in an open position in order to allow pressure medium to reach tank 110. In this way, vibratory system 100 can provide startup assistance based on inducing an artificially elevated load on input pump/motor 104, based on proportionally charging accumulator 116 while vibratory system 100 is off, or based on pressure medium supplied by output motor 106 during deceleration of vibratory system 100.

In some implementations, the capability to charge accumulator 116 based on pressure medium supplied by output motor 106 (e.g., during deceleration of vibratory system 100) can be integrated with any one or more of the above described implementations. As examples, FIGS. 8-10 are diagrams of vibratory systems 100 in which startup assistance can be provided based on charging accumulator 116 during deceleration of vibratory systems 100.

Figure 8:
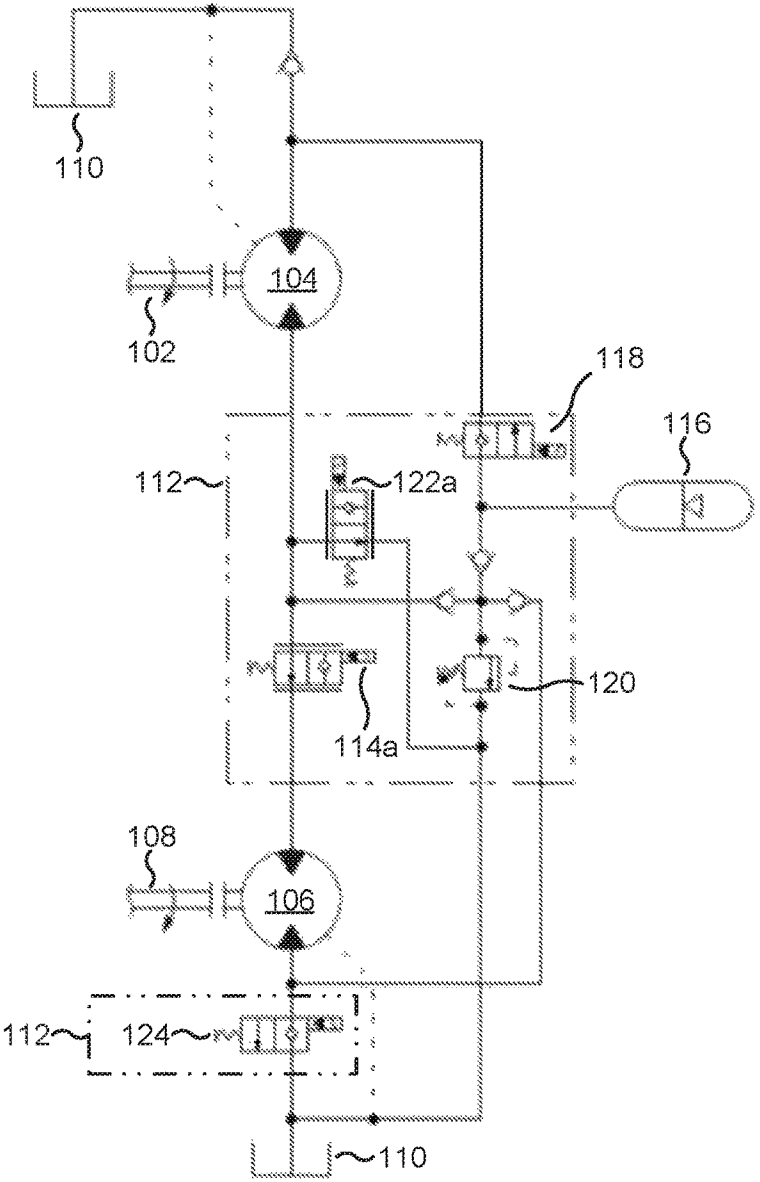

Vibratory system 100 of FIG. 8 integrates the capability to charge accumulator 116 based on pressure medium supplied by output motor 106 with the capability to charge accumulator 116 based on an artificially elevated load and the capability to proportionally charge accumulator 116 while vibratory system 100 is off, as described above in association with vibratory system 100 of FIG. 4.

Figure 9:
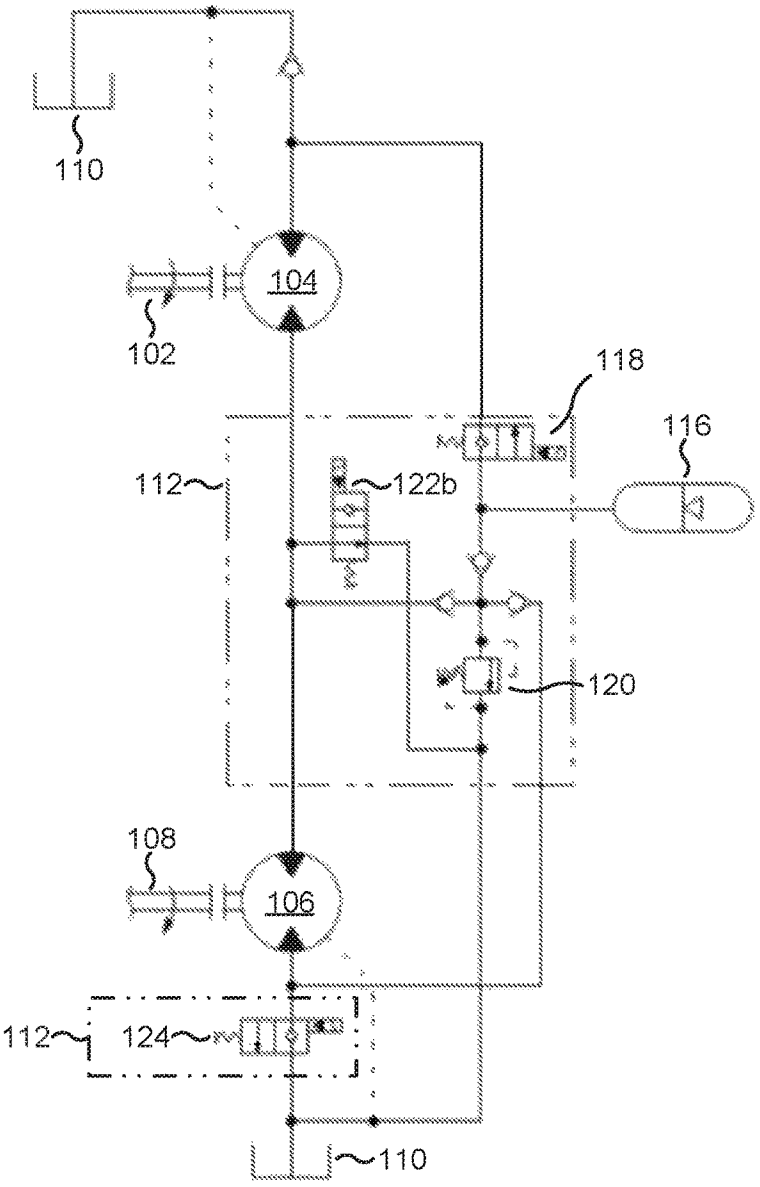

Vibratory system 100 of FIG. 9 integrates the capability to charge accumulator 116 based on pressure medium supplied by output motor 106 with the capability to charge accumulator 116 while vibratory system 100 is off, as described in association with vibratory system 100 of FIG. 5.

Figure 10:
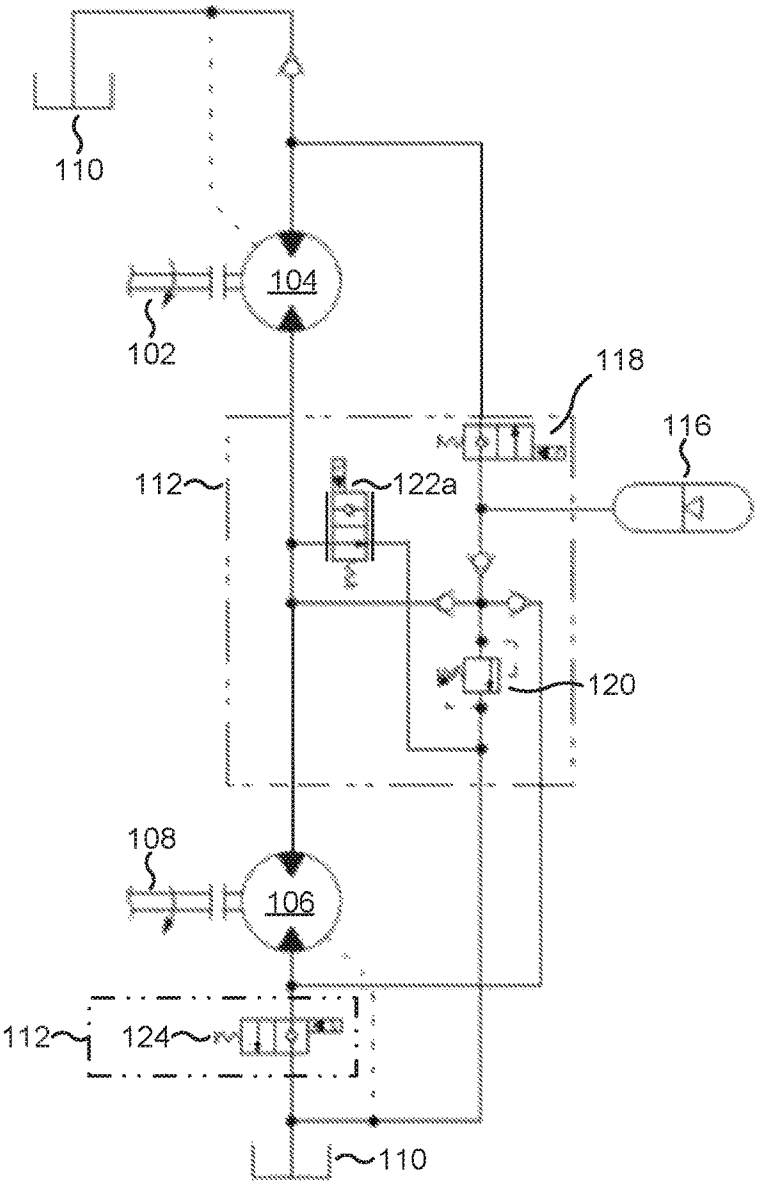

Vibratory system 100 of FIG. 10 integrates the capability to charge accumulator 116 based on pressure medium supplied by output motor 106 with the capability to proportionally charge accumulator 116 while vibratory system 100 is off, as described in association with vibratory system 100 of FIG. 6.

As indicated above, FIGS. 2-10 are provided as examples. Other examples are possible and may differ from what was described in connection with FIGS. 2-10.

For example, while switching valves described above (e.g., proportional switching valve 114*a*, switching valve 114*b*, switching valve 118, proportional switching valve 122*a*, switching valve 122*b*, switching valve 124, and/or the like) are shown as two-way valves, these components can be another type of valve, such as a poppet valve, a spool valve, a three-way valve, a four-way valve, or another type of valve suitable to provide the functionality described here, as will be appreciated by those skilled in the art.

Further, while particular components of vibratory systems 100 shown in FIGS. 2-10 are shown in a particular arrangement, components of any of these vibratory systems 100 can be arranged in a different manner while providing the same functionality.

Additionally, other combinations of charging are possible. For example, vibratory system 100 can be configured with the capability to charge accumulator 116 based on pressure medium supplied by output motor 106 and/or the capability to charge accumulator 116 based on an artificially elevated load (e.g., without the capability to charge accumulator 116 while the vibratory system is off).

As another example, vibratory system 100 can be configured with the capability to charge accumulator 116 based on pressure medium supplied by output motor 106 only (e.g., without the capability to charge accumulator 116 based on an artificially elevated load or the capability to charge accumulator 116 while the vibratory system is off). In other words, other implementations are possible, as will be appreciated by those skilled in the art.

As another example, vibratory system 100 can be configured with the capability to proportionally charge accumulator 116 based on pressure medium supplied by output motor 106. For example, in some implementations, switching valve 124 may be a proportional switching valve (e.g., instead of a switching valve that is either in an open position or a closed position) arranged, for example, at the location shown in FIG. 7, 8, or 9. In this example, the proportional switching valve provides the capability for proportional charging of accumulator 116 based on pressure medium supplied by output motor 106. Further, in some implementations, such a proportional switching valve can be used in order to induce an artificially elevated load at input pump/motor 104 in order to charge accumulator 116, in a manner similar to that described above. Additionally, in some implementations, switching valve 124 (or a proportional switching valve) can be used in order to prevent output motor 106 from turning in order to allow accumulator 116 to be charged while vibratory system 100 is off, as described above.

Furthermore, while the techniques and apparatuses described herein are described in the context of vibratory system 100 included in compactor 10, these techniques and apparatuses can be applied in another type of hydraulic system, such as any hydraulic system for which a power requirement is reduced after startup of the hydraulic system.

Figure 11:
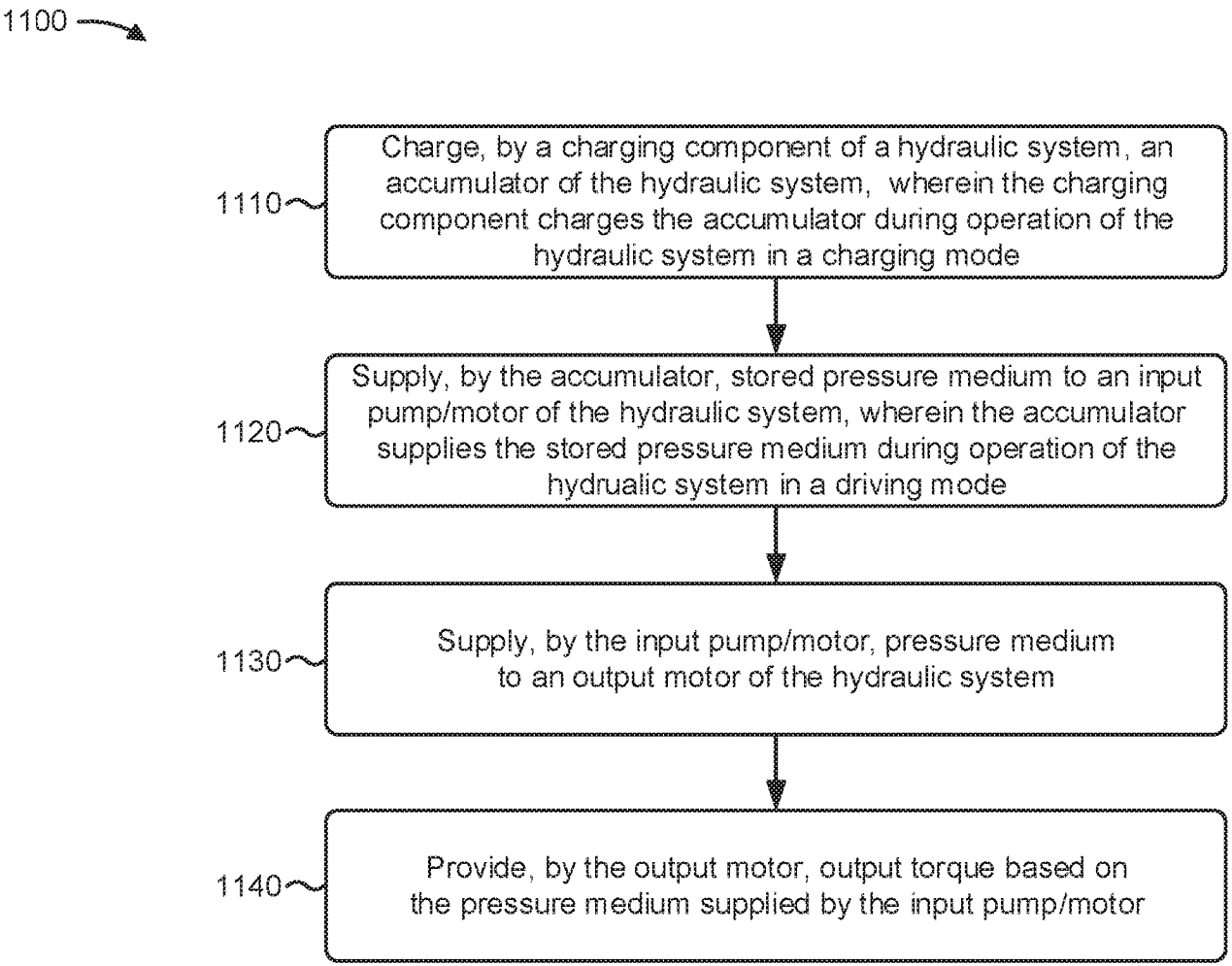
FIG. 11 is a diagram of an example process for charging an accumulator during operation of a hydraulic system in a charging mode, and supplying stored pressure medium to an input pump/motor during operation of the hydraulic system in a driving mode.

FIG. 11 is a flow chart of an example process 1100 for charging accumulator 116 during operation of a hydraulic system in a charging mode, and supplying stored pressure medium to an input pump/motor 104 during operation of the hydraulic system in a driving mode. In some implementations, one or more process blocks of FIG. 11 may be performed by a hydraulic system (e.g., vibratory system 100).

As shown in FIG. 11, process 1100 may include charging, by a charging component of a hydraulic system, an accumulator of the hydraulic system wherein the charging component charges the accumulator during operation of the hydraulic system in a charging mode (block 1010). For example, charging component 112 may charge accumulator 116 of vibratory system 100, wherein charging component 112 charges accumulator 116 during operation of vibratory system 100 in a charging mode, as described above.

As further shown in FIG. 11, process 1100 may include supplying, by the accumulator, stored pressure medium to an input pump/motor of the hydraulic system, wherein the accumulator supplies the stored pressure medium during operation of the hydraulic system in a driving mode (block 1020). For example, accumulator 116 may supply stored pressure medium to input pump/motor 104 of vibratory system 100, wherein accumulator 116 supplies the stored pressure medium during operation of vibratory system 100 in a driving mode, as described above.

As further shown in FIG. 11, process 1100 may include supplying, by the input pump/motor, pressure medium to an output motor of the hydraulic system (block 1030). For example, input pump/motor 104 may supply pressure medium to output motor 106 of vibratory system 100, as described above.

As further shown in FIG. 11, process 1100 may include providing, by the output motor, output torque based on the pressure medium supplied by the input pump/motor (block 1040). For example, output motor 106 may provide output torque based on the pressure medium supplied by input pump/motor 104, as described above.

Process 1100 may include additional aspects, such as any single aspect or any combination of aspects described below and/or in connection with one or more other processes described elsewhere herein.

In some implementations, during operation in the charging mode, charging component 112 charges accumulator 116 based on an artificially elevated load on input pump/motor 104.

In some implementations, during operation in the charging mode, charging component 112 charges accumulator 116 while output motor 106 is not caused to turn.

In some implementations, during operation in the charging mode, charging component 112 charges accumulator 116 based on pressure medium supplied by output motor 106.

Although FIG. 11 shows example blocks of process 1100, in some implementations, process 1100 may include additional blocks, fewer blocks, different blocks, or differently arranged blocks than those depicted in FIG. 11. Additionally, or alternatively, two or more of the blocks of process 1100 may be performed in parallel.

INDUSTRIAL APPLICABILITY

Vibratory systems 100 and other similarly configured hydraulic systems (collectively referred to as "the disclosed systems") may be used with any machine where energy recovery and/or start assist is desired, such as vibratory system 100 of compactor 10.

In operation, the disclosed systems include a charging component 112 to charge accumulator 116 during operation in a charging mode, and accumulator 116 to supply input pump/motor 104 during operation in a driving mode.

Several advantages may be associated with the disclosed systems. For example, during operation in the driving mode, input pump/motor 104 can be supplied by accumulator 116 (e.g., after accumulator 116 is charged during operation in a charging mode), which reduces an amount of input torque needed to drive input pump/motor 104. Thus, an amount of power required to be supplied by engine 20 (e.g., during startup of vibratory system 100) in order to drive input pump/motor 104, is reduced.

Further, since accumulator 116 supplies input pump/motor 104 (e.g., rather than output motor 106), tight coordination between input pump/motor 104 and output motor 106 is not needed, since complex switching scenarios, timing issues, and/or the like, are eliminated (e.g., as compared to those present in some other hydraulic systems that may be capable of performing energy recovery).

Additionally, the disclosed hydraulic systems are capable of charging accumulator 116 during various operational states (e.g., during operation at steady state, while vibratory system 100 is off, during deceleration of vibratory system 100, and/or the like), rather than only in an overrun mode.

What is claimed is:

1. A compactor, comprising:

a vibratory system to selectively operate in a charging mode or a driving mode, the vibratory system comprising:

a charging component to charge an accumulator during operation of the vibratory system in the charging mode, the vibratory system operating in the charging mode after vibration occurs at a desired vibratory speed;

the accumulator to:

store pressure medium during operation of the vibratory system in the charging mode, and supply stored pressure medium to an input pump/motor during operation in the driving mode;

the input pump/motor to:

supply pressure medium to at least the accumulator during operation of the vibratory system in the charging mode, and supply pressure medium to an output motor during at least operation of the vibratory system in the driving mode; and the output motor to provide, to a vibration component of the vibratory system, output torque based on pressure medium supplied by the input pump/motor.

2. The compactor of claim 1, wherein, during operation in the charging mode, the charging component is to charge the accumulator based on an artificially elevated load on the input pump/motor, wherein the charging component proportionally induces the artificially elevated load on the input pump/motor.

3. The compactor of claim 2, wherein the input pump/motor is to supply pressure medium to the output motor during operation in the charging mode.

4. The compactor of claim 1, wherein, during operation in the charging mode, the charging component is to charge the accumulator while the output motor is not caused to turn.

5. The compactor of claim 4, wherein the charging component proportionally charges the accumulator while the output motor is not caused to turn.

6. The compactor of claim 1, wherein, during operation in the charging mode, the charging component is to charge the accumulator based on pressure medium supplied by the output motor during deceleration of the vibratory system.

7. The compactor of claim 1, wherein the charging component is to charge the accumulator before the output motor is supplied by the input pump/motor.

8. The compactor of claim 1, wherein, during operation in the driving mode, the input pump/motor operates a motor when being supplied pressure medium by the accumulator, and operates as a pump when receiving input torque from an engine of the compactor.

9. A hydraulic system to selectively operate in a charging mode or a driving mode, the hydraulic system comprising:

a charging component to charge an accumulator during operation in the charging mode, the hydraulic system operating in the charging mode after vibration occurs at a desired vibratory speed;

the accumulator to:

store pressure medium during operation in the charging mode, and supply stored pressure medium to an input pump/motor during operation in the driving mode;

the input pump/motor to:

supply pressure medium to at least the accumulator during operation in the charging mode, and supply pressure medium to an output motor during at least operation in the driving mode; and the output motor to provide output torque based on pressure medium supplied by the input pump/motor.

10. The hydraulic system of claim 9, wherein, during operation in the charging mode, the charging component is to charge the accumulator based on an artificially elevated load on the input pump/motor.

11. The hydraulic system of claim 10, wherein the input pump/motor is further to supply pressure medium to the output motor during operation in the charging mode.

12. The hydraulic system of claim 9, wherein, during operation in the charging mode, the charging component is to charge the accumulator while the output motor is not caused to turn.

13. The hydraulic system of claim 12, wherein the charging component proportionally charges the accumulator while the output motor is not caused to turn.

14. The hydraulic system of claim 9, wherein, during operation in the charging mode, the charging component is to charge the accumulator based on pressure medium supplied by the output motor.

15. The hydraulic system of claim 9, wherein the charging component is to charge the accumulator before the output motor is supplied by the input pump/motor.

16. The hydraulic system of claim 9, wherein, during operation in the driving mode, the input pump/motor operates a motor when being supplied pressure medium by the accumulator, and operates as a pump when receiving input torque from an engine.

17. A method, comprising:

charging, by a charging component of a hydraulic system, an accumulator of the hydraulic system, wherein the charging component charges the accumulator during operation of the hydraulic system in a charging mode, and wherein the hydraulic system operates in the charging mode after vibration is occurring at a desired vibratory speed;

supplying, by the accumulator, stored pressure medium to an input pump/motor of the hydraulic system, wherein the accumulator supplies the stored pressure medium during operation of the hydraulic system in a driving mode;

supplying, by the input pump/motor, pressure medium to an output motor of the hydraulic system; and providing, by the output motor, output torque based on the pressure medium supplied by the input pump/motor.

18. The method of claim 17, wherein, during operation in the charging mode, the charging component charges the accumulator based on an artificially elevated load on the input pump/motor.

19. The method of claim 17, wherein, during operation in the charging mode, the charging component charges the accumulator while the output motor is not caused to turn.

20. The method of claim 17, wherein, during operation in the charging mode, the charging component charges the accumulator based on pressure medium supplied by the output motor.

* * * * *